United States Patent [19]

Kass-Pious

[11] Patent Number: 4,897,947

[45] Date of Patent: Feb. 6, 1990

[54] IDENTIFICATION HOLDER FOR MOUNTING ON SHOES

[76] Inventor: Stephanie Kass-Pious, 157 Tremont St., Hartford, Conn. 06105

[21] Appl. No.: 294,217

[22] Filed: Jan. 9, 1989

[51] Int. Cl.[4] ..... A44C 3/00

[52] U.S. Cl. ..... 40/636; 206/232; 206/534; 224/253; 36/114; 36/136

[58] Field of Search ..... 40/636, 639, 640, 641, 40/304; 36/136, 132, 114; 206/0.81, 232, 303, 534, 806; 2/247, 245; 224/252, 253, 239, 240

[56] References Cited

U.S. PATENT DOCUMENTS

| | | | |
|---|---|---|---|
| 1,701,595 | 2/1929 | Taylor | 206/0.81 |
| 2,871,537 | 2/1959 | Hickerson | 40/636 |
| 3,631,613 | 1/1972 | Brettell | 36/136 |
| 4,254,566 | 3/1981 | Haskell | 40/636 |
| 4,327,512 | 5/1982 | Oliver | 40/636 |
| 4,327,512 | 5/1982 | Oliver | 36/136 |
| 4,328,978 | 5/1982 | McLaughlin | 40/640 |
| 4,372,060 | 2/1983 | Adamik | 36/136 |
| 4,406,385 | 9/1983 | Pribyl | 224/253 |
| 4,467,947 | 8/1984 | Minneman | 224/253 |
| 4,507,882 | 4/1985 | Harrell | 36/136 |
| 4,516,337 | 5/1985 | Adamik | 36/136 |
| 4,536,975 | 8/1985 | Harrell | 36/136 |
| 4,597,198 | 7/1986 | Schweitzer | 36/100 |
| 4,611,416 | 9/1986 | Lin | 36/136 |
| 4,630,383 | 12/1986 | Gamm | 36/136 |

*Primary Examiner*—James T. McCall
*Assistant Examiner*—J. R. Hakomaki

[57] ABSTRACT

An identification member adapted to be secured to shoes having laces or straps includes an integrally formed carrier of synthetic resin having a base and a cover which are hingedly connected along one side margin thereof. The base provides a cavity in which is seated an identification element, and the cover and base have interfitting side walls which engage in the closed position. Depending from the bottom wall of the base is a U-shaped engagement loop through which a shoelace or strap passes to secure the carrier to the top of the shoe.

9 Claims, 2 Drawing Sheets

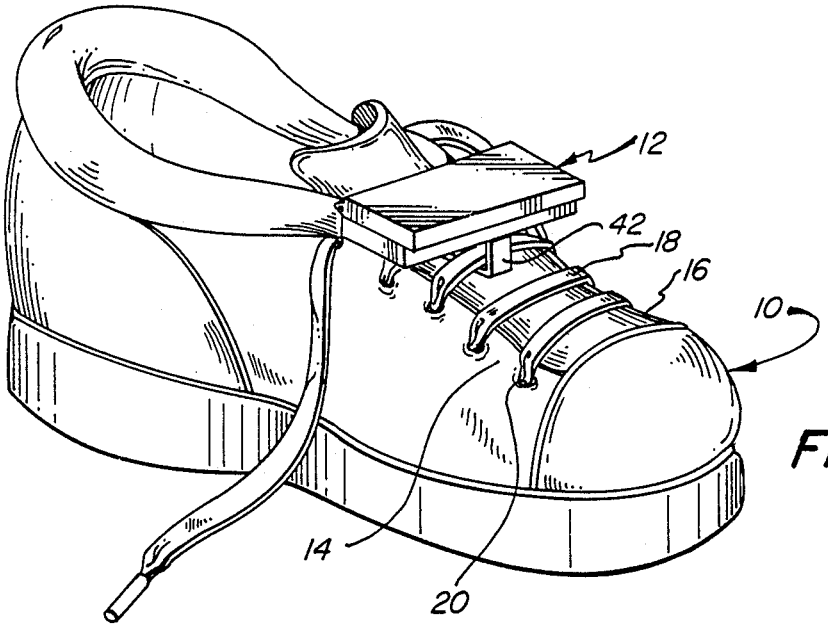
FIG. 1
FIG. 2
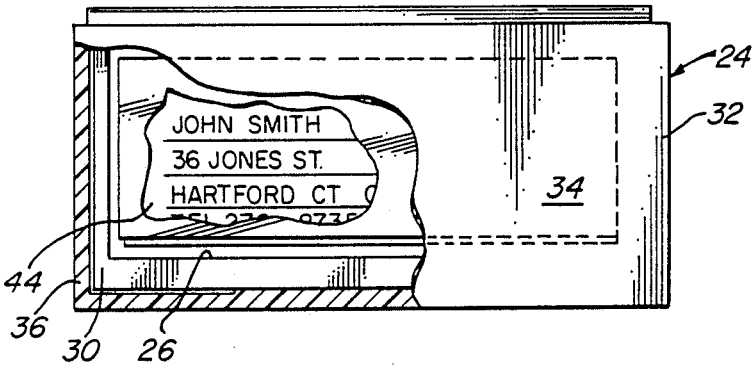
FIG. 3
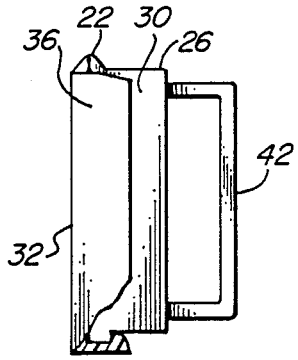
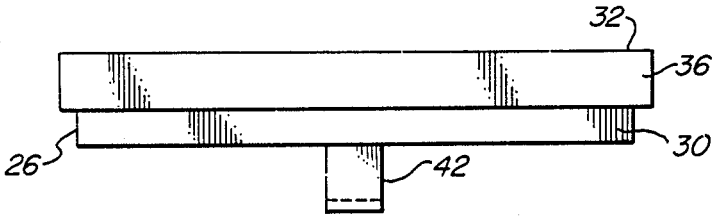
FIG. 4

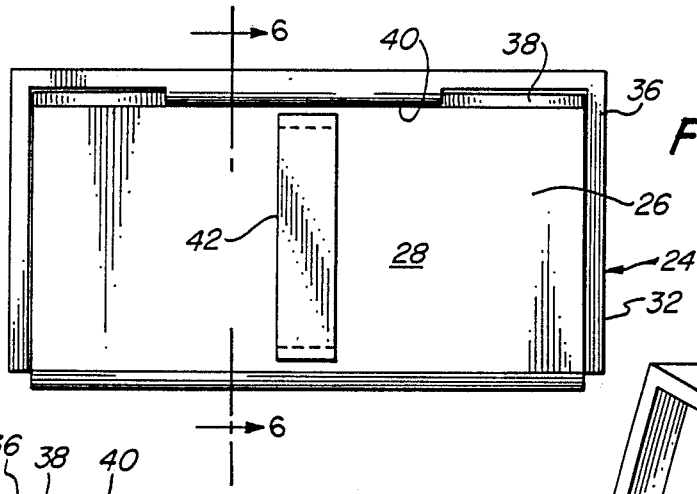
FIG. 5
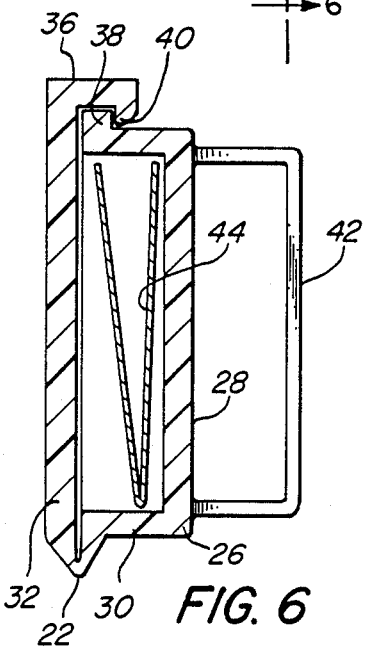
FIG. 6
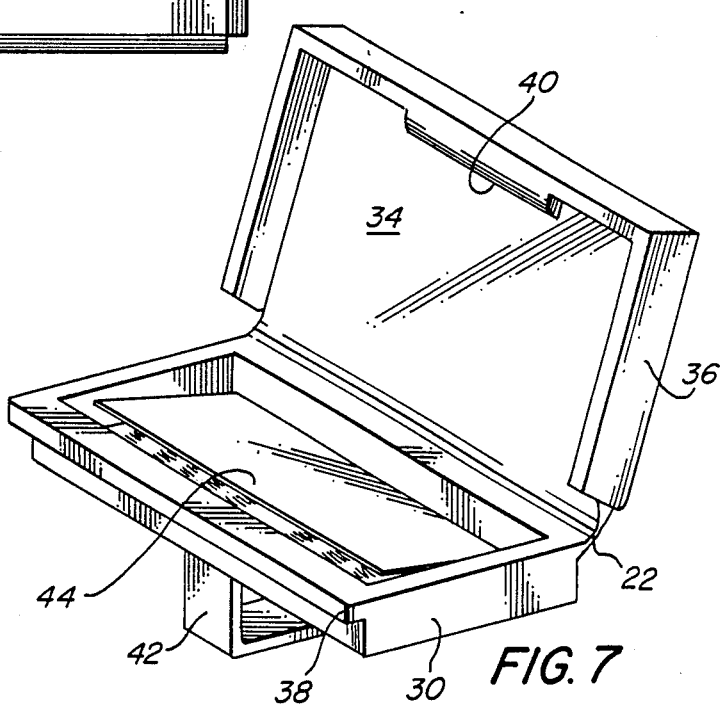
FIG. 7
FIG. 8
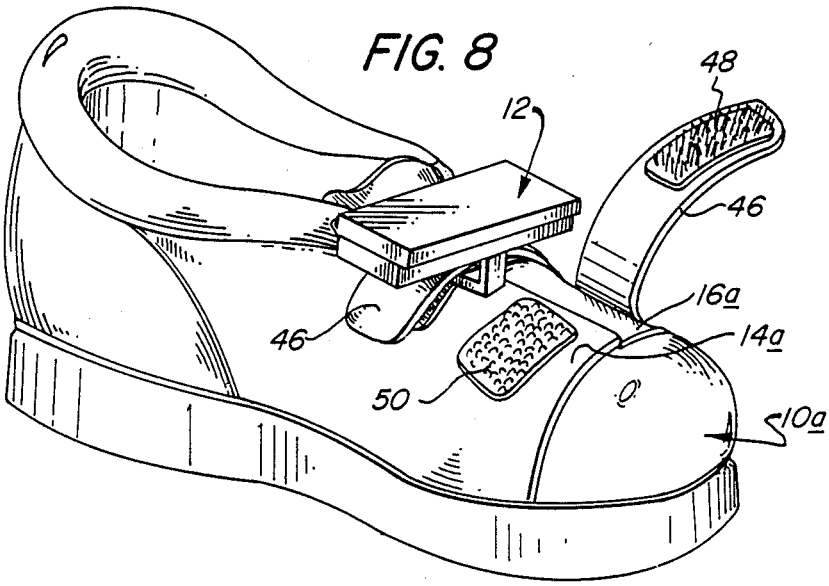

IDENTIFICATION HOLDER FOR MOUNTING ON SHOES

BACKGROUND OF THE INVENTION

The present invention relates to identification members for mounting upon shoes and like footwear and, more particularly, to such a member having an integrally formed carrier for an identification card of the like and which may be readily mounted on shoes employing laces and straps.

As is well known, it is desirable to carry identification upon the person at all times and this is particularly true for those persons who have medical conditions which should be disclosed to any treating agency in the event that the person is incapacitated and unable to communicate.

In some instances, carriers have been integrally formed with the shoe to carry money for emergency purposes as exemplified by Gamm U.S. Pat. No. 4,547,982. In still other instances, it has been proposed to mount decorative emblems upon the shoes such as, for example, shown in Schweitzer U.S. Pat. No. 4,597,198. Exemplary of the devices utilized to carry identification and emergency items are Harrell U.S. Pat. No. 4,536,975; Brettell U.S. Pat. No. 3,631,613; Oliver U.S. Pat. No. 4,327,512; and Haskell U.S. Pat. No. 4,254,566.

It is an object of the present invention to provide a novel identification member which may be readily mounted upon conventional footwear employing laces or straps to secure the flaps and tighten the shoe about the foot.

It is also an object to provide such an identification member which may be readily fabricated and which is highly durable.

Another object is to provide such an identification member in which the carrier for the identification card or the like is reasonably sealed to minimize the penetration of dirt and the like into the carrier and which also may be readily opened and closed.

SUMMARY OF THE INVENTION

It has now been found that the foregoing and related objects and advantages may be readily attained in an identification member adapted to be secured to a shoe or the like having lacing or like elements extending transversely the flaps. It includes an integrally formed carrier of synthetic resin having a base and cover hingedly connected along one side margin thereof, and the base has a bottom wall and a sidewall extending about the periphery thereof to define an upwardly opening cavity. The base also has an elongated, generally U-shaped engagement loop depending from the bottom wall and providing a passage through which shoe laces or the like may be passed to secure the carrier to the top of the associated shoe. The cover has a top wall and a depending sidewall extending about at least the major portion of its periphery. The sidewalls of the base and cover are dimensioned and configured to interfit, and the cover is releasably engaged with the base to close the cavity. Removably seated within the carrier is an identification element.

In the preferred embodiment, the sidewall of the base has outwardly extending flanges at its upper end along the one side margin and along the side margin opposite thereto. The cover has an inwardly projecting boss on the lower end of its sidewall opposite the one side margin and the boss snap fits under the flange on the base. The hinged connection is provided along the outer edge of the flange on the base. The sidewall on the cover extends along the margin opposite that providing the hinged connection and along the adjacent side margins to provide a generally U-shaped side wall receiving the sidewalls of the base therebetween.

Most usually, the carrier is rectangular and elongated in the axis parallel to the hinged connection, and the engagement loop extends transversely of the elongated dimension. Preferably, the carrier is fabricated from a polyolefin polymer.

In use, the identification member is used with a shoe or like footwear having a pair of opposed flaps and at least one tightening element extending transversely between the flaps. This tightening element is usually a shoelace and extends through the passage of the U-shaped loop on the base to secure the carrier to the top of the shoe. The identification element is imprinted with desired information and is removably seated within the carrier. To open and close the carrier, the cover is snapped from the base.

BRIEF DESCRIPTION OF THE DRAWINGS

FIG. 1 is a perspective view of a shoe having mounted thereon an identification member embodying the present invention;

FIG. 2 is a top plan view of the engagement member of FIG. 1 drawn to an enlarged scale and with a portion of the cover broken away;

FIG. 3 is an end elevational view of the engagement member;

FIG. 4 is a front elevational view thereof;

FIG. 5 is a bottom view thereof;

FIG. 6 is a cross sectional view thereof along the line 6—6 of FIG. 5;

FIG. 7 is a perspective view thereof with the cover pivoted into an open position; and FIG. 8 is a perspective view of the carrier as mounted upon another type of shoe using hook and loop fiber elements to secure the tightening straps.

DETAILED DESCRIPTION OF PREFERRED EMBODIMENT OF THE INVENTION

In FIG. 1, therein illustrated is a conventional is shoe generally designated by the numeral 10 upon which is mounted an identification member embodying the present invention and generally designated by the numeral 12.

The shoes 10 upon which the present invention may be mounted generally have a pair of flaps 14, 16 which are secured in a tightened relationship by a tightening member 18. In the illustrated embodiment, the shoe flaps 14, 16 have eyelets 20 between which the shoelace 18 extends generally transversely.

The identification member 12 includes an integrally formed carrier generally designated by the numeral 24 and having an elongated rectangular configuration.

The carrier 24 includes a base 26 with a bottom wall 28 and a upstanding peripheral sidewall 30 defining a cavity therewithin. Hingedly connected to the base 26 by the self-hinging flap 22 along the elongated side margin is the cover 32 which has a top wall 34 and a depending sidewall 36 which extends along the opposite elongated side margin and the adjacent side margins.

The base 26 has outwardly extending flanges 38 extending along the upper end of the sidewall 30 at the hinged side margin and at the opposite side margin. The hinged connection or hinge flap 22 is at the outer edge of the flange 38. The cover 32 has an inwardly extending boss 40 on its sidewall 36 along the side margin opposite the hinged connection, and this snap fits under the flange 38 when the cover 32 is closed. In the closed position, the sidewall 36 fits over the sidewall 30 and front flange 38 to provide partial sealing of the cavity. Depending from the bottom wall 28 is a generally U-shaped loop 42 providing a passage through which the shoelace 18 extends at least twice.

Inside the cavity of the carrier 24 is an identification card 44 which bears various indicia thereon.

As seen in FIG. 6, the identification card 44 is conveniently folded to provide more space for recording information. Multiple identification elements can be stored within the relatively deep cavity, and ideally the elements themselves are of a waterproof finish for maximum durability. In addition, keys and money may also be placed therein.

The carrier may be readily opened by springing the cover upwardly with sufficient force to cam the boss 40 over the flange 38, and thereby to pivot the cover upwardly into the position seen in FIG. 7.

In FIG. 8, the identification member is shown as mounted on a shoe 10*a* in which the flaps 14*a*,16*a* are held tightly together by elongated straps 46 which are secured by cooperating hook and loop fiber elements 48,50.

Although various materials may be utilized for molding the carrier, polyolefins such as high density polyethylene and polyproplene are particular useful since they exhibit self-hinging properties, are relatively low cost and are highly durable over a wide temperature range.

Although the carrier has been shown as elongated and of generally rectangular configuration, other configurations may also be employed, and the carrier may be reduced in size, particularly for children's shoes. In the illustrated embodiment, the sidewall 36 terminates a substantial distance from the point of hinged connection between the cover and the base. It may be extended to a point closely adjacent the hinged connection to improve the sealing characteristics of the cover when it interfits over the base.

Thus, it can be seen that the identification member of the present invention may be fabricated readily with the carrier being integrally formed by molding from synthetic resin to provide an attractive and durable member which can withstand athletic activities and the like. The member is one which may be mounted securely and easily upon a shoe, sneaker or the like, and access to the identification information upon the card and other items placed therewithin may be readily obtained.

Having thus described the invention, I claim:

1. An identification member adapted to be secured to a shoe or the like having lacing or like elements extending transversely thereof, comprising:

(a) an integrally formed elongated carrier or synthetic resin having a base and cover hingedly connected along one side margin thereof, said base including a bottom wall and a sidewall extending about the periphery thereof to define an upwardly opening cavity, said sidewall of said base having outwardly extending flanges at its upper end along said one side margin and along the side margin opposite thereto, said base also having an elongated, generally U-shaped engagement loop depending from said bottom wall and providing a passage through which shoe laces or the like may be passed to secure the carrier to the top of the associated shoe, said engagement loop extending transversely of the elongated dimension, said cover having a top wall and a depending sidewall extending about the major portion of its periphery, said sidewalls of said base and cover being dimensioned and configured to interfit with said base extending into said cover, said cover being releasably engaged with said base to close said cavity, said cover having an inwardly projecting boss on the lower end of its sidewall opposite said one side margin and said boss snap fitting under said flange on said base, said hinged connection being provided along the outer edge of said flange on said base, said sidewall on said cover extending along said margin opposite that providing the hinged connection and along the adjacent side margins to provide a generally U-shaped sidewall which receives the base therebetween;

(b) an identification element removably seated within said carrier.

2. An identification member in accordance with claim 1 wherein said carrier is rectangular and elongated in the axis parallel to said hinged connection.

3. In combination:

(a) a shoe or the like having a pair of opposed flaps and at least one tightening element extending transversely between said flaps; and (b) an identification member secured on said shoe and comprising:

(i) an integrally formed carrier of synthetic resin having a base and cover hingedly connected along one side margin thereof, said base including a bottom wall and a sidewall extending about the periphery thereof to define an upwardly opening cavity, said base having an elongated, generally U-shaped engagement loop depending from said bottom wall and providing a passage through which said tightening element passes to secure said carrier to the top of said shoe, said cover having a top wall and a depending sidewall extending about the major portion of its periphery, said sidewalls of said base and cover being dimensioned and configured to interfit with said base extending into said cover, said cover being releasably engaged with said base to close said cavity, and (ii) an identification element removably seated within said carrier.

4. An identification member in accordance with claim 3 wherein said sidewall of said base has outwardly extending flanges at its upper end along said one side margin and along the side margin opposite thereto.

5. An identification member in accordance with claim 4 wherein said cover has an inwardly projecting boss on the lower end of its sidewall opposite said one side margin and said boss snap fits under said flange on said base.

6. An identification member in accordance with claim 4 wherein said hinged connection is provided along the outer edge of said flange on said base.

7. An identification member in accordance with claim 5 wherein said sidewall on said cover extends along said margin opposite that providing the hinged connection and along the adjacent side margins to provide a generally U-shaped sidewall which receives the base therebetween.

8. An identification member in accordance with claim 3 wherein said carrier is rectangular and elongated it the axis parallel to said hinged connection.

9. An identification member in accordance with claim 8 wherein said engagement loop extends transversely of the elongated dimension.

* * * * *